US006607194B2

(12) United States Patent
Moeller et al.

(10) Patent No.: US 6,607,194 B2
(45) Date of Patent: Aug. 19, 2003

(54) DEVICE FOR HOLDING THE TOP SHEET OF A STACK OF SHEETS

(75) Inventors: Siegfried Moeller, Rottweil (DE); Klaus Paulat, Schoonebuerg (DE)

(73) Assignee: BDT Buro-Und Datentechnik GmbH & Co., KG (DE)

( * ) Notice: Subject to any disclaimer, the term of this patent is extended or adjusted under 35 U.S.C. 154(b) by 0 days.

(21) Appl. No.: 10/085,604

(22) Filed: Feb. 26, 2002

(65) Prior Publication Data

US 2002/0158406 A1 Oct. 31, 2002

(30) Foreign Application Priority Data

Feb. 26, 2001 (DE) ..... 101 09 168

(51) Int. Cl.[7] ..... B65H 31/26
(52) U.S. Cl. ..... 271/220; 271/207
(58) Field of Search ..... 271/220, 207, 271/211

(56) References Cited

U.S. PATENT DOCUMENTS 4,577,853 A * 3/1986 Duke ..... 271/217
5,033,731 A * 7/1991 Looney ..... 271/176
5,094,660 A * 3/1992 Okuzawa ..... 493/320
5,228,679 A * 7/1993 Borostyan ..... 271/213
5,685,536 A * 11/1997 Barthold ..... 271/220
6,095,518 A * 8/2000 Allmendinger et al. ..... 271/215

FOREIGN PATENT DOCUMENTS

JP 10-250897 9/1998
WO WO90/15770 A1 12/1990

* cited by examiner

*Primary Examiner*—Donald P. Walsh
*Assistant Examiner*—Kaitlin S Joerger
(74) *Attorney, Agent, or Firm*—Baker Botts L.L.P.

(57) ABSTRACT

An arrangement to hold a top sheet of a stack of sheets that are ejected by an office machine and deposited on the stack is disclosed. The arrangement comprises a holding element and a lifting device adapted to vertically move the holding element. A tension spring is adapted to be tensioned when the holding element is placed on the stack, thereby generating a placement force. The lifting device may comprise an upper part where the holding element is arranged and a lower part. The lower part is vertically driven, and the upper part and the lower part being connected by the tension spring. The holding element may be a holding flap that is pivotally positioned at the lifting device and is adapted to pivot between a swung out position that projects over a stack of sheets and a swung in position into the lifting device. A joint drive may effect the lifting movement of the lifting device and the swinging movement of the holding flap, the holding flap being driven by a sliding clutch.

16 Claims, 4 Drawing Sheets a)

b)

DEVICE FOR HOLDING THE TOP SHEET OF A STACK OF SHEETS

BACKGROUND OF THE INVENTION

1. Field of the Invention

The invention relates to an arrangement for holding the top sheet of a stack of sheets ejected by an office machine and deposited on the stack.

2. Related Art

The sheets ejected by office machines such as printers, copiers, etc. are generally collected in a stack. The sheet ejector of an office machine ejects the sheets either individually or, for example, as already collected print jobs. If the ejected sheets come into contact with the top sheet of an already collected stack, there is a risk that the top sheet of the stack may be displaced by the ejected sheet, thus upsetting the alignment of the sheet stack. The pull of the top sheet on the stack by the ejected sheets depends on various factors such as the surface condition of the sheets, electrostatic charges, weight of the sheets, number and size of the sheets, and the air humidity, for example.

To avoid the displacement of the top sheet on the stack by the following ejected sheets, it is known to place a holding element on the top sheet of a stack while the next sheet is ejected. The holding element holds the top sheet of the stack while the next sheet is deposited on the stack. The holding element is then moved away from the stack so as to not prevent the stacking and alignment of the next ejected sheet.

One problem with this arrangement is placing the holding element on the top sheet of the stack with a precise placement force. A minimum of placement force is required to dependably hold the top sheet, but excessive placement force can lead to pressure marks on the sheet. With the known devices, it is difficult to maintain a precise placement force of the holding element, because the position of the upper edge of the stack is undefined. The position of the upper edge of the stack may be influenced, for example, by air pillows between the stacked sheets. Especially, there is frequently a difference in the height of the upper edge of the stack across the width of the stack resting on the alignment stop, which is particularly pronounced when several already collected and stapled sheets are deposited and stacked.

BRIEF DESCRIPTION OF THE DRAWINGS

In the following the invention will be explained in further detail in conjunction with embodiment examples depicted in the drawings, in which.

DESCRIPTION OF CERTAIN EMBODIMENT OF THE INVENTION

Figure 1:
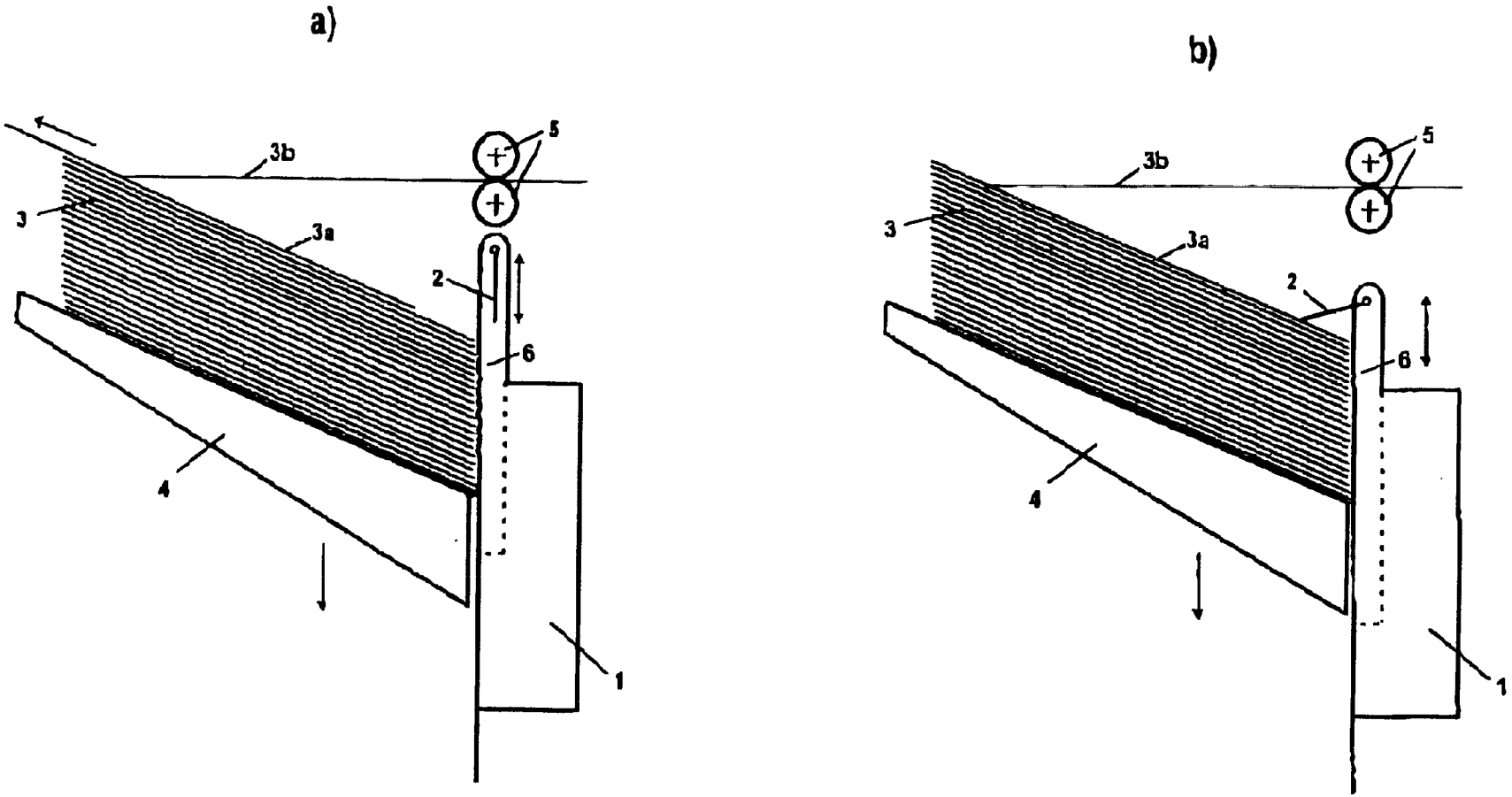
FIG. 1 illustrates an arrangement according to one embodiment of the invention.

In accordance with one embodiment of the invention, a holding element may be vertically moved by means of a lifting device and placed on the top sheet of a stack and/or removed from said stack. A spring resistance may be provided, which effects the placement force of the holding element and is tensioned when the holding element is placed. The tension of the spring resistance may depend on the placement of the holding element, so that the placement force effected by the spring resistance always has a preset value, regardless of the position of the upper edge of the stack, regardless of the different heights of the upper edge across the width of the stack, and regardless of the compressibility of the stack, for example, due to enclosed air pillows.

Preferably, the holding element is designed as a holding flap that is pivotably positioned at the lifting device. The holding flap can be swung out to rest on the top sheet of the stack, and it can be swung into the lifting device so as not to obstruct the stacking and alignment of the next sheet. The swinging out and swinging in of the holding flap is preferably coupled with the up or down movement of the lifting device so that the holding flap is compulsorily swung out during the downward movement to be placed onto the top sheet, while the holding flap is compulsorily swung in during the upward movement of the lifting device.

In a preferred embodiment, the lifting device is comprised of an upper part where the holding flap is positioned and a lower part that can be driven for the vertical movement. The upper part and the lower part may be connected by a tension spring that generates the tension that determines the stacking force. When the holding element is placed on the top sheet of the stack, the upper part of the lifting device may be held fixedly while the lower part is moved on by the drive to tense the tension spring to a preset value of spring resistance. In that way, the movement of the upper part with the holding element can be preferably monitored through a sensor device so that a precisely defined starting point can be determined for the tensioning of the tension spring.

In another embodiment of the invention, the same drive may be used for the lifting movement of the lifting device and for the swinging out and swinging in of the holding flap. The swinging out and swinging in of the holding flap may occur immediately during the downward or upward movement of the lifting device due to an internal gearbox ratio. The holding flap may be driven by a sliding clutch that disables the drive once the holding flap has reached the respective end positions of its swinging movement.

The arrangement in accordance with the invention enables the holding of the top sheet of the stack with a defined and, if necessary, adjustable stacking force regardless of fluctuations and irregularities of the upper edge of the stack, whereby the entire arrangement has a simple construction and may require only a drive motor.

Referring now to the drawings, specifically FIGS. 1*a* and 1*b*, an office machine (not shown), such as a printer or a copier, ejects the sheets printed, for example, in the office machine either individually or as a collection of several sheets, through driven ejection rollers 5. The ejected sheets 3 are stacked on a stacking table 4. If necessary, the stacking table 4 may be developed such that it can be adjusted to the height of the stack of sheets 3.

FIG. 1*a* shows how a sheet 3*b* ejected by the ejection rollers 5 is stacked on the stack of sheets 3. The forward edge of the sheet 3*b* reaches the top sheet 3*a* of the stack. In that way, the feed of the page 3*b*, which is driven by the ejection rollers 5, can cause the top sheet 3*a* of the stack to be carried along by friction and displaced from its aligned position on the stack. To avoid this undesired effect, a holding element in accordance with the invention may be used. One embodiment of a holding element is illustrated in FIGS. 1*a* and 1*b* as a holding flap 2. The holding flap 2 may be lifted and lowered vertically by means of a lifting device 6 of a holding arrangement 1. In the lowered position, shown in FIG. 1*b,* the holding flap 2 is positioned on the top sheet 3*a* of the stack and holds the top sheet 3*a,* for example, with a placement force of 0.4 to 1.0 N. The following sheet 3*b*, which is ejected by the ejection rollers 5, cannot displace the top sheet 3*a* held by the holding flap 2, and thus the aligned stack of the sheets 3 is not upset.

To allow the following ejected sheet 3*b* to be deposited and aligned on the stack by the holding flap 2 without interference, the holding flap 2 must be swung away from the top sheet 3*a* of the stack as soon as the following sheet 3*b* is no longer driven through the ejection rollers 5 and can thus no longer transmit any feed force to the top sheet 3*a.*

Figure 5:
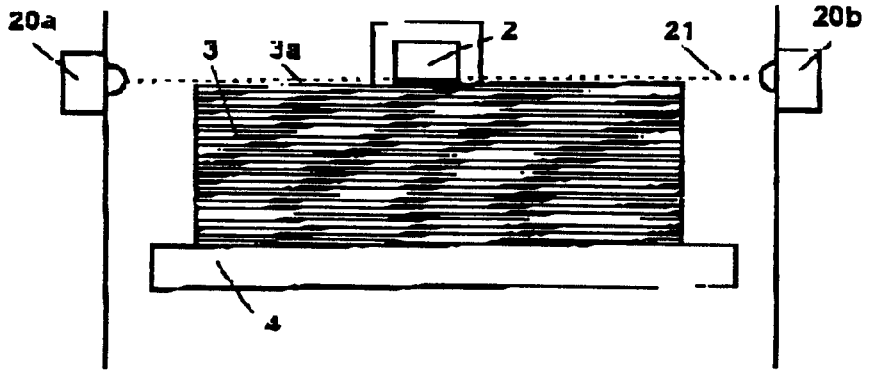
FIG. 5 shows a representation of a problem overcome by an embodiment of the invention.
Figure 5:
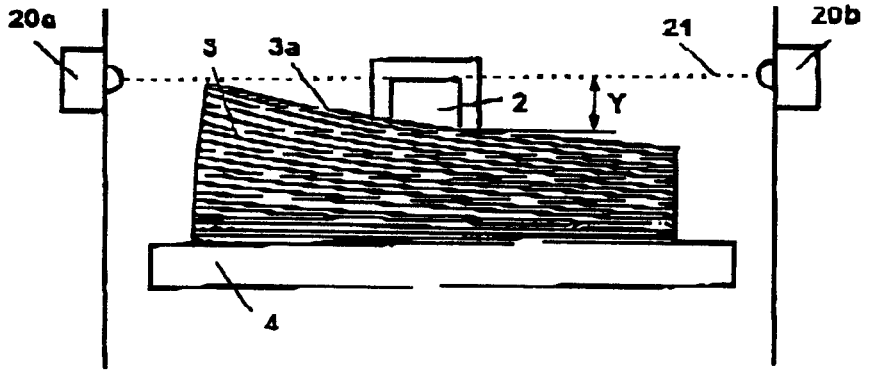

The holding element, such as the holding flap 2, preferably rests on the top sheet 3*a* with a placement force that remains approximately within the aforementioned limits of 0.4 to 1.0 N. The placement force is required on the one hand to dependably hold the top sheet 3*a*, even if several sheets collected in the office machine, such as a complete print job, for example, are ejected jointly. Such collected sheets, for example up to 50 sheets, exert a correspondingly higher feed force on the top sheet 3*a* of the stack. On the other hand, however, the placement force of the holding element cannot be too high in order to avoid any pressure marks on the top sheet 3*a*. The placement of the holding element on the top sheet 3*a* of the stack with a defined placement force is particularly difficult because the upper edge of the stack of sheets 3 does not have a specifically defined position with respect to the stacking table 4. A positioning of the holding element relative to the stacking table 4, therefore, does not lead to a defined position of the holding element relative to the upper edge of the stack and thus not to a definite stacking force. FIG. 5, for example, shows that the upper edge of the stack of sheets 3 is scanned by means of an optical sensor arrangement 20*a*, 20*b* of the type of a light barrier. However, the sensing height 21 of said optical sensor arrangement 20*a*, 20*b* can determine only the highest point of the top sheet 3*a*. Only in the ideal case shown in FIG. 5*a* does the position of the top sheet 3*a* correspond across its entire width to the sensing height 21 of the optical sensor arrangement 20*a*, 20*b*, and thus also to the placement point of the holding flap 2. In most cases, however, the height of the top sheet 3*a* varies across the width of the stack. For example, if printing sets comprised of several sheets are ejected, which are stapled at one side, the height of the stack of sheets 3 will increase more on the side where the staples are located than in the remaining area of the upper edge of the stack, as is shown in FIG. 5*b*. There will be a height difference Y between the sensing height 21 of the optical sensor arrangement 20*a*, 20*b* and the height of the placement point of the holding flap 2. The arrangement in accordance with the invention allows the tolerance of such height differences Y without any effect on the placement force of the holding flap 2.

Figure 3:
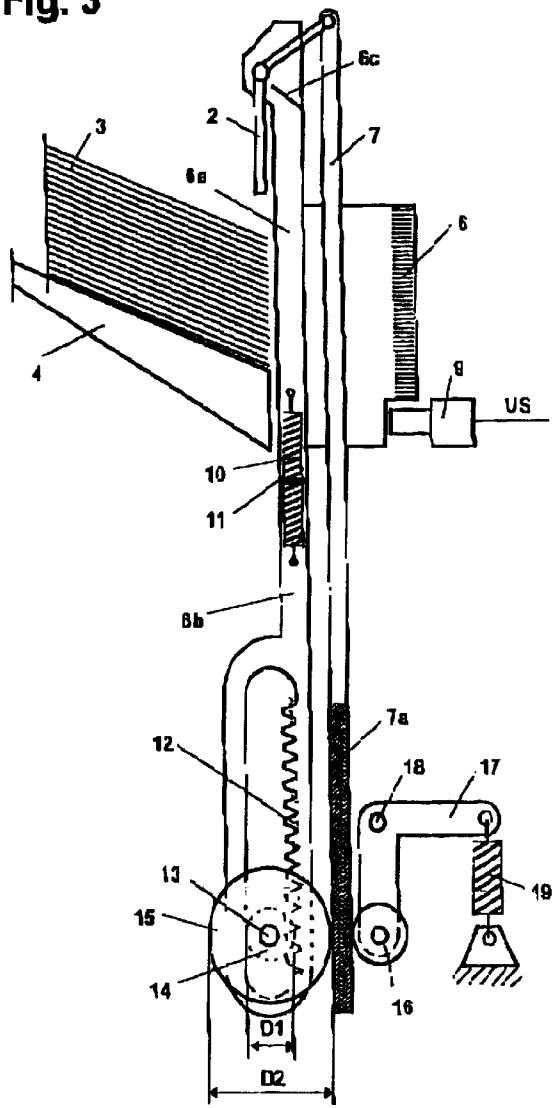
FIG. 3 illustrates an arrangement according to an embodiment of the invention.

Referring now to FIG. 3, an arrangement according to one embodiment of the invention is illustrated. The lifting device 6 is comprised of an upper part 6*a* and a lower part 6*b,* which are vertically guided along an alignment edge of the sheet stack and can be displaced. The upper part 6*a* and the lower part 6*b* are separated from one another, and a tension spring 10, which is fastened at the upper part 6*a* as well as at the lower part 6*b,* holds the parts 6*a* and 6*b* together at an abutting surface 11 when no forces acting against the force of the tension spring 10 act on the upper part 6*a*.

Figure 2:
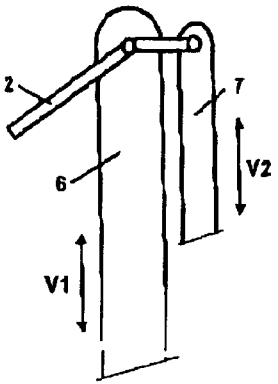
FIG. 2 illustrates one embodiment of a holding flap and its operation.

At the upper part 6*a* of the lifting device 6, the holding flap 2 is linked to swing around a horizontal axis. One embodiment of the holding flap 2 is developed as a two-arm lever; one lever arm rests on the stack of sheets 3, while a control tappet 7 engages at the other lever arm. If the control tappet 7 is slid vertically upward relative to the upper part 6*a* of the lifting device 6, the holding flap 3 is swung into the position shown in FIG. 3, where it is positioned at the upper part 6*a* and stops to delimit the swinging movement. If the control tappet 7 is moved vertically downward relative to the lifting device 6, the holding flap 2 is swung away from the upper part 6*a* so that it projects above the stack of sheets 3, as is shown in FIG. 2. A stop 6*c* is attached at the upper part 6*a* and delimits the swinging movement.

In the illustrated embodiment, the lower part 6*b* of the lifting device 6 has a vertically arranged linear toothed wheel work 12 where a toothed wheel 14 located non-rotationally on a primary shaft 13 engages, with the primary shaft 13 being driven by, for example, an electrical step motor (not shown). Depending on the turning direction of the primary shaft 13 and the toothed wheel 14, the lower part 6*b* of the lifting device may be moved vertically upward or downward.

Also non-rotationally positioned on the primary shaft 13 of the illustrated embodiment is a friction wheel 15. The diameter D3 of the friction wheel 15 is larger than the diameter D1 of the toothed wheel 14; preferably, the diameter D2 is approximately twice the diameter of D1. The friction wheel 15 engages near the lower end of the control tappet 7, which is preferably developed with a friction surface 7*a* in the lower area, to ensure a good frictional engagement between the friction wheel 15 and the control tappet 7. The control tappet 7 may be pressed against the perimeter of the friction wheel 15 by means of a pressing wheel 16 to effect a defined frictional engagement. For this purpose, the pressing wheel 16 of the illustrated embodiment is positioned at a lever 17 that can pivot around a pivoting point 18 and is loaded by a spring 19. When the friction wheel 15 is turned by the primary shaft 13 driven by the step motor, the control tappet 7 is moved vertically upward or downward, depending on the turning direction of the friction wheel 15. Because of the ratio of the diameters D1 and D2, the control tappet 7 is moved with a speed V2 that is in the same direction, but is greater than the speed V1 of the lower part 6*b* of the lifting device 6. If the diameter D2 of the friction wheel 15 is twice as large as the diameter D1 of the toothed wheel 14, the control tappet 7 is moved with a speed V2 that is twice as high as the speed V1 of the lifting device 6. The frictional engagement between the friction wheel 15 and the control tappet 7, which is pressed by the pressing wheel 16, forms a sliding clutch in the drive of the control tappet 7 by the step motor.

According to the illustrated embodiment, a sensor comb 8 running in a vertical direction and having a linear division is attached at the upper part 6*a* of the lifting device 6. The sensor comb 8 may be scanned by a sensor 9. In one embodiment, the sensor comb 8 is an optical division grid that is scanned by an optical sensor 9. During the scanning of the sensor comb 8, the sensor 9 generates output signals US, which count the vertical lifting path of the upper part 6*a*. The sensor 9 is arranged in such a way that it is located below the lower end of the sensor comb 8 and in a distance from the end when the upper part 6*a* is in its upper end position.

Figure 4:
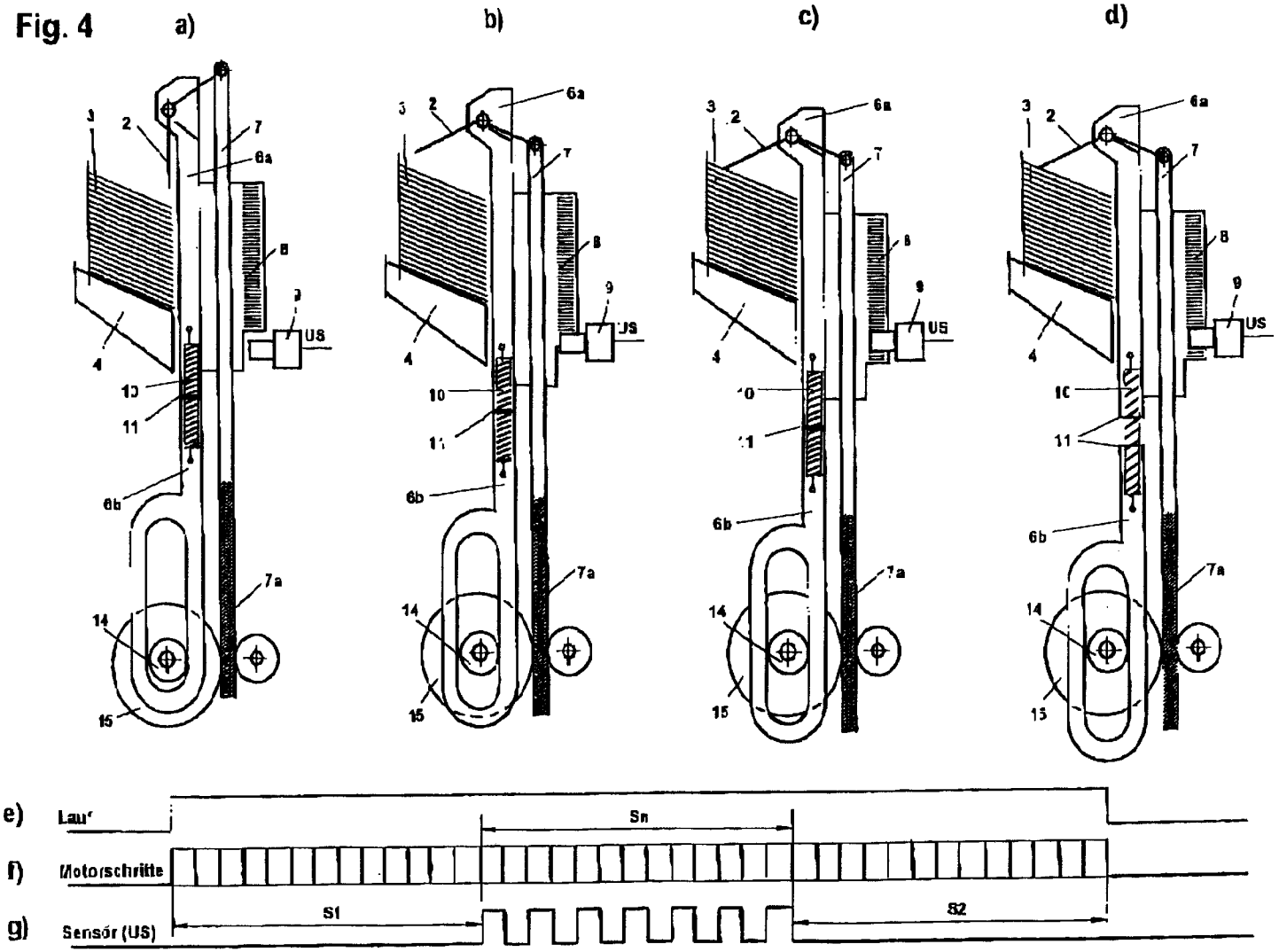
FIG. 4 illustrates the function sequence of the arrangement illustrated in FIG. 3.

The functioning of the arrangement of FIG. 3 is illustrated in FIG. 4. FIG. 4*a* shows the entire arrangement in a normal position. The lifting device 6 is vertically driven into its upper end position, with the holding flap 3 being swung to the upper part 6*a* of the lifting device 6. Any triggering process of the arrangement starts from this normal position when the office machine ejects another sheet 3*b*. The electrical step motor (not shown), for example, may be activated by a start signal given by the office machine and may run for a time period shown in FIG. 4*e*. During the run, the step motor may perform steps with constant step times and step angles, as shown in FIG. 4*f*.

The step motor, via the toothed wheel 14 and the toothed wheel work 12, moves the lifting device 6 from the normal position in FIG. 4*a* uniformly downward. Simultaneously, the control tappet 7 is moved downward by the friction wheel 15, whereby the larger speed of the control tappet 7 relative to the lifting device 6 causes the holding flap 2 to be swung out so that the arrangement reaches the position shown in FIG. 4*b*. Because of the speed-increasing ratio between the lifting device 6 and the control tappet 7, only a small vertical path of the lifting device 6 is required to swing out the holding flap 2. Thus, the holding flap 2 is completely swung out before it touches the top sheet of the stack of sheets 3, as is shown in FIG. 4*b*.

After the step motor has performed S1 steps, the holding flap 2 is completely swung out, and the sensor comb 8 has reached the sensor 9. The sensor 9 then generates output signals US, which show the further vertical movement of the upper part 6*a* connected to the sensor comb 8. FIG. 4*g* shows the output signals US generated by the sensor 9.

During the movement from the position shown in FIG. 4*a* to the position shown in FIG. 4*b*, the upper part 6*a* is carried along by the driven lower part 6*b* of the lifting device 6, because the tension spring 10 holds the parts 6*a* and 6*b* together at the abutting surface 11. During its swing movement, the holding flap 2 does not offer any resistance to the control tappet 7 so that the control tappet 7 is moved by the friction wheel 15 without slippage.

Once the holding flap 2 is completely swung out in the position shown in FIG. 4*b*, it sits closely at the stop 6*c*. Thus, the control tappet 7 can move downward only at the same speed as the upper part 6*a* of the lifting device. Thus, there is now some slippage between the friction wheel 15 and the control tappet 7. The upper part 6*a* and lower part 6*b* of the lifting device 6 and the control tappet 7 now move downward together at the same speed until the holding flap 2 sits closely on the stack of sheets 3 in the position shown in FIG. 4*c*. In that way, the step motor performs Sn steps, and the sensor 9 generates corresponding output signals US, as is shown in the representation of FIGS. 4*f* and 4*g*. The number of steps, S1+Sn, which the step motor executes from the normal position shown in FIG. 4*a* until the holding flap 2 sits closely on the stack in the position in FIG. 4*c*, may depend on the distance between the placement point of the holding flap 2 on the stack and the normal position of the lifting device 6. As already explained earlier, substantial fluctuations are possible here. For example, the arrangement in accordance with the invention may allow for differences of 50 mm or more.

As soon as the holding flap 2, which was blocked in its swinging movement by the stop 6*c*, sits closely on the stack, the upper part 6*a* of the lifting device 6 can no longer continue to move downward. Thus, the upper part 6*a* cannot continue to follow the downward movement of the lower part 6*b* driven by the step motor through the toothed wheel 14. Thus, the lower part 6*b* moves away from the upper part 6*a*, and the tension spring 10 is tensed, as is shown in FIG. 4*d*. The control tappet 7, which is held at the upper part 6*a* by the blocked holding flap 2, also cannot continue to move downward, so that the friction wheel 15 spins relative to the control tappet 7 similar to a slipped clutch.

Once the upper part 6*a* is held by the holding flap 2 sitting on the stack, the sensor comb 8 also no longer moves. Thus, the sensor 9 does not generate any further output signals US, as is shown in FIG. 4*g*. Once the positioning of the holding flap 2 on the stack is signaled by the absence of the output signals US of the sensor 9, the step motor may only perform a preset number of steps S2 and then stop. The number of the steps S2 determines how far the lower part 6*b* is pulled away from the upper part 6*a* and thus how strong the tension spring 10 is tensioned. Because the force of the tension spring 10 determines the stacking force of the holding flap 2 on the stack, a precise setting of the stacking force of the holding flap 2 can be achieved by presetting the number of steps S2.

The arrangement now remains in the position shown in FIG. 4*d*, where the holding flap 2 sits on the top sheet of the stack with the preset stacking force and holds the top sheet until the next sheet 3*b* is ejected by the office machine. When the ejection of the following sheet 3*b* is completed, the step motor is again triggered by a corresponding signal and then activated in the opposite turning direction.

In this way, the lower part 6*b* of the lifting device 6 may first be slid upward by the toothed wheel 14. As long as the tension spring 10 remains tensioned, the upper part 6*a* may be held with the holding flap 2 sitting on the stack. In this way, the control tappet 7 also cannot move at first, so that there is again a slippage between the friction wheel 15 and the control tappet 7. As soon as the lower part 6*b* and the upper part 6*a* are again joined at their abutting surfaces 11, the upper part 6*a* may also again be slid vertically upward by the driven lower part 6*b*. In this way, the holding flap 2 is lifted from the stack and released. Thus, the friction wheel 15 can again engage in a friction with the control tappet 7 and slide the control tappet 7 upward at the higher speed V2 relative to the upper part 6*a*. Thus, the holding flap may again be swung very quickly against the upper part 6*a* in the position shown in FIG. 3. The swung-in holding flap 2 thus does not obstruct the stacking and alignment of the ejected sheet 3*b* and its trailing edge on the stack.

The upward movement of the lifting device 6 may then continue until the sensor comb 8 leaves the area of the sensor 9, which is indicated by the absence of the output signal US of the sensor 9. Once there are no further signals US coming from the sensor, the step motor may continue to perform only S1 steps until the lifting device has again resumed the normal position shown in FIG. 4*a*, and then stop. The arrangement is then again in the normal position 4*a* until the next sheet ejection cycle is started.

While particular embodiments of the present invention have been disclosed, it is to be understood that various different modifications and combinations are possible and are contemplated within the true spirit and scope of the appended claims. There is no intention, therefore, of limitations to the exact abstract or disclosure herein presented.

List of reference symbols

| | |
|---|---|
| 1 | Holding arrangement |
| 2 | Holding flap |
| 3 | Sheets |
| 3a | Top sheet |

-continued

| List of reference symbols | |
|---|---|
| 3b | Following (next) sheet |
| 4 | Stacking table |
| 5 | Ejection rollers |
| 6 | Lifting device |
| 6a | Upper part of the lifting device |
| 6b | Lower part of the lifting device |
| 7 | Control tappet |
| 7a | Friction surface |
| 8 | Sensor comb |
| 9 | Sensor |
| 10 | Tension spring |
| 11 | Abutting surfaces |
| 12 | Toothed wheel work |
| 13 | Primary shaft |
| 14 | Toothed wheel |
| 15 | Friction wheel |
| 16 | Pressing wheel |
| 17 | Lever |
| 18 | Pivot point |
| 19 | Spring |
| 20a/20b | Optical sensor arrangement |
| 21 | Scanning height |
| D1 | Diameter of the toothed wheel |
| D2 | Diameter of the friction wheel |
| S1 | Starting steps of the motor |
| S2 | After-running steps of the motor |
| Sn | Steps of the motor during the signal of the sensor |
| US | Output signals of the sensor |
| Y | Height difference of the upper edge of the stack |

What is claimed is:

1. An arrangement to hold a top sheet of a stack of sheets that are ejected by an office machine and deposited on the stack, comprising:

a holding element adapted to be placed on the top sheet with a placement force and moved away from said top sheet;

a lifting device adapted to vertically move the holding element to be placed on the stack and lifted off the stack; and a tension spring adapted to be tensioned when the holding element is placed on the stack, thereby generating a placement force of the holding element.

2. The arrangement in accordance with claim 1, wherein the lifting device comprises an upper part where the holding element is arranged and a lower part, said upper part and said lower part being vertically guided, said lower part being vertically driven, and said upper part and said lower part being connected by said tension spring.

3. The arrangement in accordance with claim 1, wherein said holding element is a holding flap that is pivotally positioned at the lifting device, said flap being adapted to pivot between a swung out position that projects over a stack of sheets and a swung in position into the lifting device.

4. The arrangement in accordance with claim 3, wherein the holding flap is swung out when the lifting device is moved downward, and wherein the holding flap is swung in when the lifting device is moved upward.

5. The arrangement in accordance with claim 4, wherein a joint drive effects the lifting movement of the lifting device and the swinging movement of the holding flap, the holding flap being driven by a sliding clutch.

6. The arrangement in accordance with claim 3, wherein the lower part has a linear toothed wheel work for the vertical movement, said toothed wheel work adapted to be engaged by a driven toothed wheel, a pivoting movement of the holding flap being linked at the upper part of the lifting device and being effected by a vertically movable control tappet, said control tappet being driven with frictional engagement by a friction wheel, said friction wheel and said toothed wheel being driven by the same drive.

7. The arrangement in accordance with claim 6, wherein the control tappet is driven by the friction wheel in the same movement direction, but at a higher speed than the lower part being driven by a toothed gear.

8. The arrangement in accordance with claim 3, wherein the swinging movement of the holding flap is limited by stops.

9. The arrangement in accordance with claim 1, wherein a lifting path of the lifting device is determined by a linear path measuring device.

10. The arrangement in accordance with claim 9, wherein the linear path measuring device comprises a sensor comb and a sensor.

11. The arrangement in accordance with claim 9, wherein the lifting device is adapted to be driven by an electrical step motor, and wherein the path measuring device is adapted to control the step motor for a defined lifting path to tension the spring resistance.

12. A system for securing a top sheet of a stack of sheets, comprising:

a lifting device having an upper portion and a lower portion;

resilient means for resiliently engaging said upper portion to said lower portion;

a control tappet being substantially parallel to said lifting device;

ratchet means for controlling a vertical position of said lower portion, said ratchet means frictionally engaging said control tappet; and a holding element pivotably mounted to said upper portion of said lifting device, said holding member having a free end, a pivot point and a connection end, said connection end engaging said control tappet.

13. The system according to claim 12, wherein said resilient means is a tension spring.

14. The system according to claim 12, wherein said ratchet means is a friction wheel.

15. The system according to claim 12, further comprising a motor for driving said ratchet means.

16. A method for securing a top sheet of a stack of sheets, comprising:

placing a holding element on the top sheet with a placement force and moved away from said top sheet;

vertically moving the holding element to be placed on the stack and lifted off of the stack; and generating a placement force on the holding element when the holding element is placed on the stack.

* * * * *